US005351752A

United States Patent [19]

Wood et al.

[11] Patent Number: 5,351,752

[45] Date of Patent: Oct. 4, 1994

[54] ARTIFICIAL LIFTING SYSTEM

[75] Inventors: Steven M. Wood, Tulsa, Okla.; Blaine Tew, Lincoln, Nebr.

[73] Assignees: Exoko, Incorporated (Wood), Tulsa, Okla.; Brunswick Corporation (TEW), Skokie, Ill.

[21] Appl. No.: 906,669

[22] Filed: Jun. 30, 1992

[51] Int. Cl.[5] ..... E21B 17/20; E21B 43/00

[52] U.S. Cl. ..... 166/68; 138/109; 166/105; 166/242; 417/450

[58] Field of Search ..... 166/68, 68.5, 105, 369, 166/242, 241.3, 106, 84; 417/493, 450, 448, 449; 138/153, 172, 109

[56] References Cited

U.S. PATENT DOCUMENTS

| | | | |
|---|---|---|---|
| 712,486 | 11/1902 | Black | 166/241.3 |
| 1,547,895 | 7/1925 | Brock | 166/68 |
| 2,137,853 | 11/1938 | Nixon | 166/84 X |
| 2,156,709 | 5/1939 | Taylor | 166/106 |
| 2,162,001 | 6/1939 | Cox | 417/450 |
| 2,180,880 | 11/1939 | Poulsen | 166/78 |
| 2,394,189 | 2/1946 | Kaufman . | |
| 2,843,054 | 7/1958 | Crake | 166/105.2 |
| 3,282,340 | 11/1966 | Park | 417/450 X |
| 3,566,924 | 3/1971 | Ambrus et al. | 138/153 X |
| 3,889,579 | 6/1975 | Wiechowski | 92/3 |
| 4,139,334 | 2/1979 | Payne | 417/545 |
| 4,693,281 | 9/1987 | Creedon | 138/172 X |
| 4,762,474 | 8/1988 | Dartnall | 417/469 |
| 5,080,943 | 1/1992 | Chulpsa | 138/153 X |
| 5,110,644 | 5/1992 | Sparks et al. | 166/242 X |

*Primary Examiner*—Hoang C. Dang

*Attorney, Agent, or Firm*—Wood, Phillips, VanSanten, Hoffman & Ertel

[57] ABSTRACT

An artificial lifting system is designed for use at a pumping installation which has a pump drive at the surface or head end of a well and a reciprocating pump positioned in the lower end of the well. The artificial lifting system has a tubing string connected between the pump drive and the pump for performing the dual functions of reciprocating the pump plunger in response to activation of the pump drive, and for transporting oil from the underground source to the wellhead. The tubing string advantageously is constructed of a plurality of lightweight, non-metallic tubing segments which are axially connected to form an elongated conduit of several thousand feet in length. In the exemplary embodiment, the tubing segments are made of a glass and carbon reinforced epoxy resin. Preferably, the composite material has a density of approximately 0.1 pounds per cubic inch and a fiber content of approximately 60% by volume, with the resulting composite material having an elastic modulus in excess of 700,000 psi. The invention additionally is directed to various structural features for facilitating the implementation of such a composite lifting system.

16 Claims, 11 Drawing Sheets

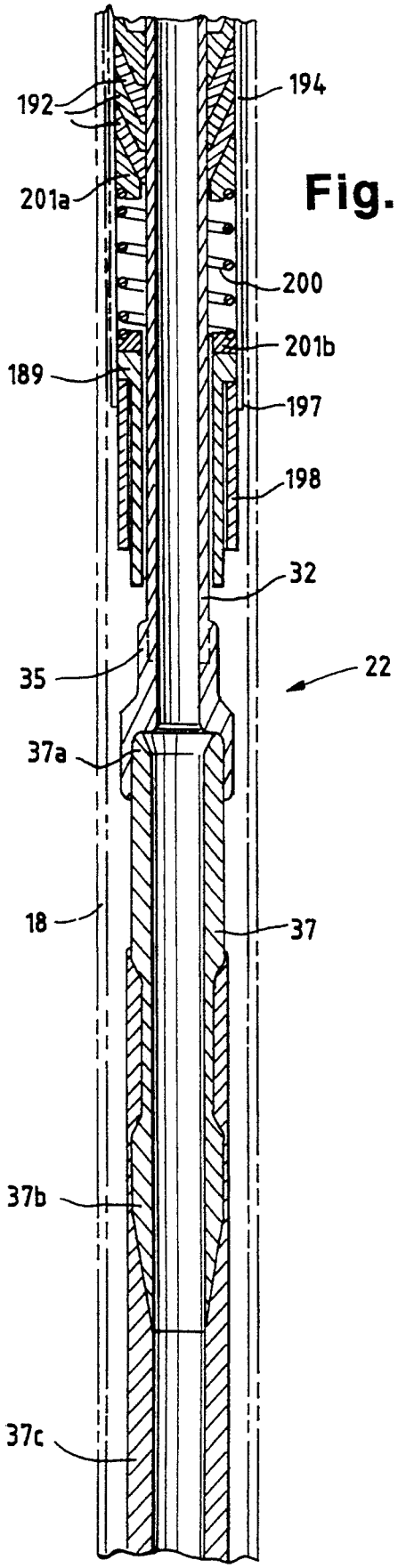
Fig. 4
Fig. 5
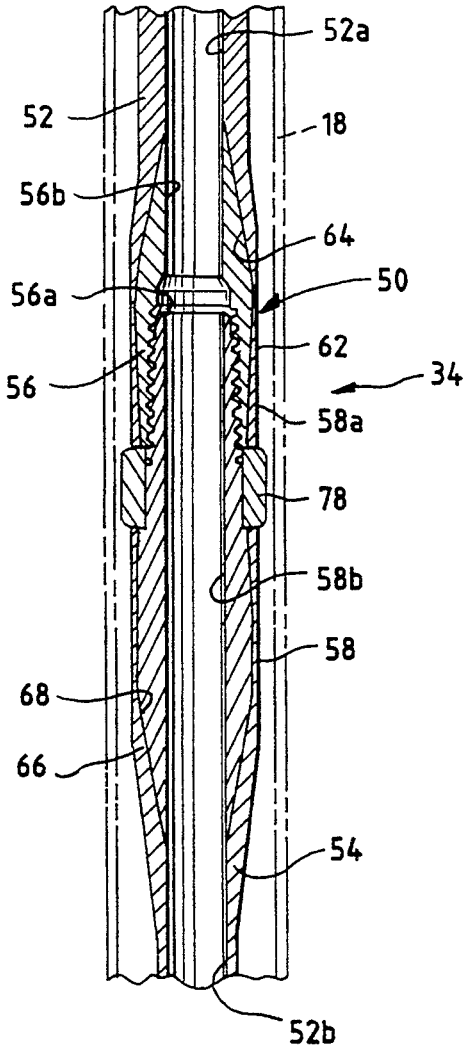

Fig. 16
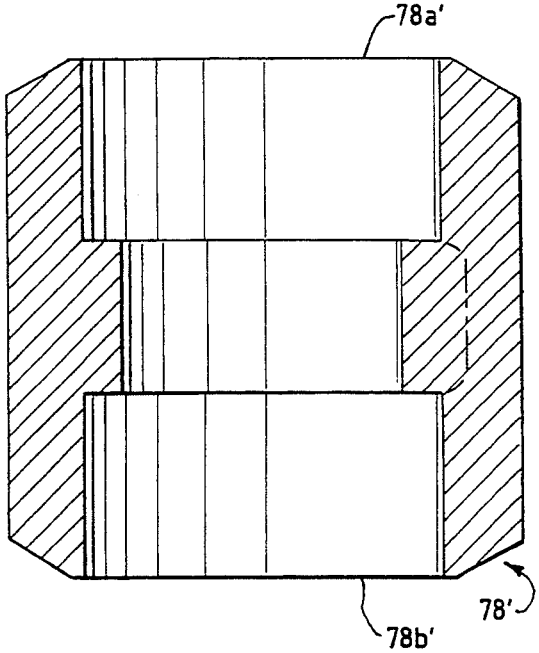
Fig. 17
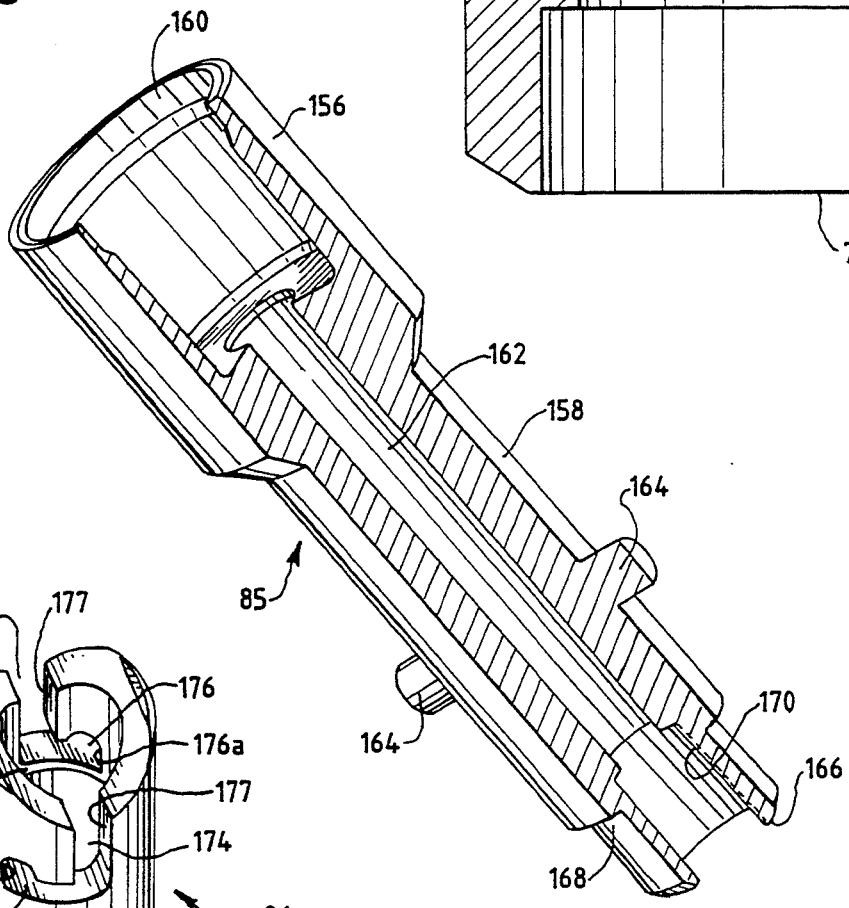
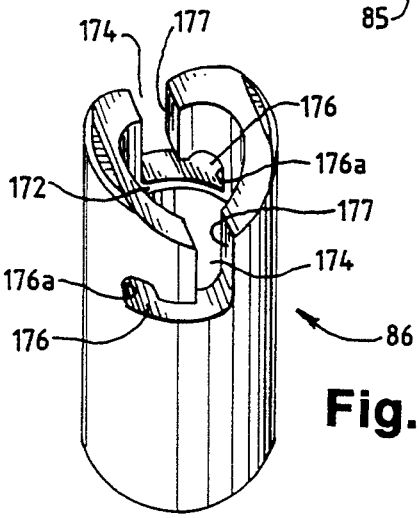
Fig. 18

ARTIFICIAL LIFTING SYSTEM

BACKGROUND OF THE INVENTION

1. Technical Field

The present invention relates generally to a system for pumping oil from a well, and more particularly to an artificial lifting system in which a composite tubing string is used for operating a reciprocating pump at the foot of the well and for transporting oil to the head of the well.

2. Background Art

Artificial lifting systems of the type commonly employed in the hydrocarbon production industry normally have a carbon steel tubing string which runs from a wellhead at the surface of the earth downwardly through a well bore to an oil bearing formation. The tube is connected at its lower end to a carbon steel or alloy pump, and the pump has a reciprocating plunger for extracting oil from the formation and transporting oil upwardly through the steel tube to the wellhead.

More particularly, the pump plunger is actuated in a reciprocating manner by a rod string which extends downwardly through the tubing string. The rod string typically is made of carbon steel or fiberglass, and is vertically lifted by a pump drive unit which is located at the wellhead and aligned directly over the well bore. Fluids which are extracted by the pump are ported into the annular space between the rod string and the tubing string. The fluids then are forced to the surface and discharged through a pumping tee to surface flow lines which, in turn, are connected to surface production and/or storage equipment.

Fluid containment at the wellhead is accomplished with a polished rod and stuffing box. The polished rod is connected to the upper end of the rod string, and is reciprocated through the stuffing box by the pump drive. The stuffing box contains a series of compression rubbers for accommodating movement of the polished rod without incurring fluid loss at the top of the tubing string.

A problem which exists with lifting systems of the character described is the likelihood of a leak developing in the tubing string, and further, the potential for structural failure in the rod string used to actuate the pump. Due to the abusive down-hole environments in which artificial lifting systems are used, and more specifically due to the deleterious nature of the fluids to which lifting systems are subjected, the tubing strings and rod strings of the current art are susceptible to corrosion, scaling and abrasive wear from fluid borne solids.

In addition, due to the minimal clearances between the rod strings and the interior surface of the tubing strings, abrasions causing tubing wear and rod failure are commonplace. As can be understood from the above discussion, either of these incidents results in a loss of operability in the lifting system and requires time-consuming and expensive repair.

The present invention is directed toward overcoming the problems set forth above and advancing the state of the lifting system art by utilizing the weight savings and corrosion resistance properties uniquely associated with composite materials. In addition, the invention is directed to various features employed with such a composite system.

SUMMARY OF THE INVENTION

It is an object of the present invention, therefore, to provide a new and improved lifting system in which a composite tubing string is used for operating a reciprocating pump within the well and for transporting oil to the surface of the well.

In the exemplary embodiment of the invention, an artificial lifting system is designed for use at a pumping installation which has a pump drive at the surface or head end of a well and a reciprocating pump positioned in the lower end or foot of the well. The artificial lifting system has a tubing string connected between the pump drive and the pump for performing the dual functions of reciprocating the pump plunger in response to activation of the pump drive, and for transporting oil from the underground source to the wellhead.

The tubing string advantageously is constructed of a plurality of lightweight, non-metallic tubing segments which are axially connected to form an elongated conduit of several thousand feet in length. The individual segments are approximately 30 to 40 feet long and are made of a fiber reinforced composite material. In the preferred embodiment disclosed herein, the tubing segments are made of a thermosetting resin which is reinforced with glass and graphite fibers. Preferably, the fiber reinforced resin has a density of less than 0.1 pounds per square inch and a fiber content of approximately 60 percent by volume, with the resulting composite material having an elastic modulus in excess of 700,000 psi.

Non-metallic threaded fittings are attached at each end of the tubing segments to Join individual segments to form a conduit of desired length. The threaded fittings are formed of fiber reinforced resin and are entrapped and bonded within the tubing segments. Each segment of tubing includes one internally threaded fitting and one externally threaded fitting. Preferably, the thread forms on the fittings are produced without cutting the fiber reinforcement within the couplings and with a thread pitch less than six threads per inch. The externally threaded fitting at the end of each tubing segment is rotatably received in an associated internally threaded fitting in the end of an adjacent tube.

Oil which is transported upwardly through the composite tubing string is discharged at an upper end thereof through a perforated hollow tube. An elongated collection tube depends from the wellhead and has a peripheral sidewall which surrounds the perforated tube. A precision seal is provided at the lower end of the collection tube for slidably receiving the perforated tube. Because the lower end of the collection tube is sealed, the collection tube defines an annular collection chamber at the top of the tubing string for receiving oil which is discharged from the perforated tube.

An anchor mechanism fixes the top of the collection tube to the wellhead assembly. The wellhead defines an upward and outwardly tapered region surrounding the top of the collection tube. Toothed grips are wedged inside the tapered space engaged with the collection tube to prevent the collection tube from moving downwardly into the well. Rubber packing elements are placed above the toothed grips. A lower lockdown member is fixed to the wellhead and is clamped into engagement with the rubber packing elements by a wellhead cap assembly. The wellhead cap is threadedly engaged with the wellhead, which, in turn, is rigidly secured to the surface casing of the well. An annular upper lockdown member engages the upper end of the collection tube, and is drawn downwardly by a number of vertical adjustment rods connected between the upper lockdown member and the lower lockdown member. Movement of the upper lockdown member toward the lower lockdown member forces the collection tube downwardly and into continuous engagement with the toothed grips.

The lower lockdown member is split axially into two halves to facilitate installation of the wellhead assembly. Once the wellhead cap assembly is mounted over the lower lockdown member, a circular split plate is bolted to an unflanged upper end of the lower lockdown member. Split locations in the lower lockdown member and circular split plate are rotated to a staggered position 90 degrees apart to rigidly secure the assembly.

A metal/composite adaptor is located at each end of the composite tubing string and provides a transition between metallic components at the top and bottom of the well and the assembled composite tubing string. A metal/composite adaptor has a corrosion resistant metallic tube with a gentle taper at one end of the adaptor and a threaded attachment at the opposite end of the adaptor. A necked center section is provided between the opposite ends of the adaptor.

Composite material is wound over the taper of the metallic tube and is entrapped and bonded to the necked section of the tube. Circumferential fibers hold the composite in the necked region and provide a strong traplock feature when cured. Diametrically opposed pins on the adaptor extend radially outward through both the composite and metal near the threaded end of the adaptor to provide torsional resistance should the bond between the composite material and the metal fail. A composite fitting is entrapped and bonded in the tapered end of the metal/composite adaptor to facilitate attachment to the composite tubing string.

A locking mechanism near the bottom of the tubing string holds the pump assembly in constant position with respect to the well casing. The mechanism is of a type whereby an application of torque actuates a number of radially extendable toothed grips for securely engaging the well casing. A clearance is maintained between the locking device and the well casing to accommodate the free flow of gaseous material. The locking mechanism advantageously is locked and unlocked without removal from the hole to allow full control of its placement within the well bore.

A J-lock mechanism is attached to the bottom of the composite tubing string and permits the transmission of torque to the lower portion of the tubing string by rotating the upper end of the string assembly, and, in addition, permits the upper end of the string assembly selectively to be reciprocated independently of the lower tubing string portion. The mechanism includes a J-lock body connected to the upper tubing string portion and a J-lock sleeve connected to the lower tubing string. The J-lock body is received in the J-lock sleeve and is selectively disengaged therefrom to permit reciprocation of the upper tubing string portion.

A reciprocating pump includes a plunger, a pump barrel for guiding reciprocal movement of the plunger, and a plunger cage valve assembly. The plunger is suspended within the pump barrel by a plunger tube connected to the J-lock body. The plunger cage assembly is connected to the bottom of a protective tube which extends downwardly from the J-lock sleeve. The pump barrel is encased within the protective tube and is attached at its bottom to the plunger cage assembly.

A bottom lock adaptor threadedly engages a standard tubing coupling which attaches the protective tube surrounding the pump. The bottom lock adaptor provides a threaded attachment point for the bottom locking mechanism and the cage assembly, with the lower end of the pump barrel supported on the cage assembly. The locking device is connected to the bottom of the protective tube by means of a cylindrical tubing coupling and a bottom lock adaptor.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the figures and in which:

FIGS. 2–10 are diagrammatic illustrations of the present lifting system, in downward sequential order of sections of the lifting system from the top wellhead to the bottom pump;

FIGS. 15 and 16 illustrate alternative embodiment of an anti-abrasion element; and FIG. 17 and 18 illustrate the a J-lock body and J-lock sleeve, respectively.

DESCRIPTION OF THE PREFERRED EMBODIMENT

Figure 1:
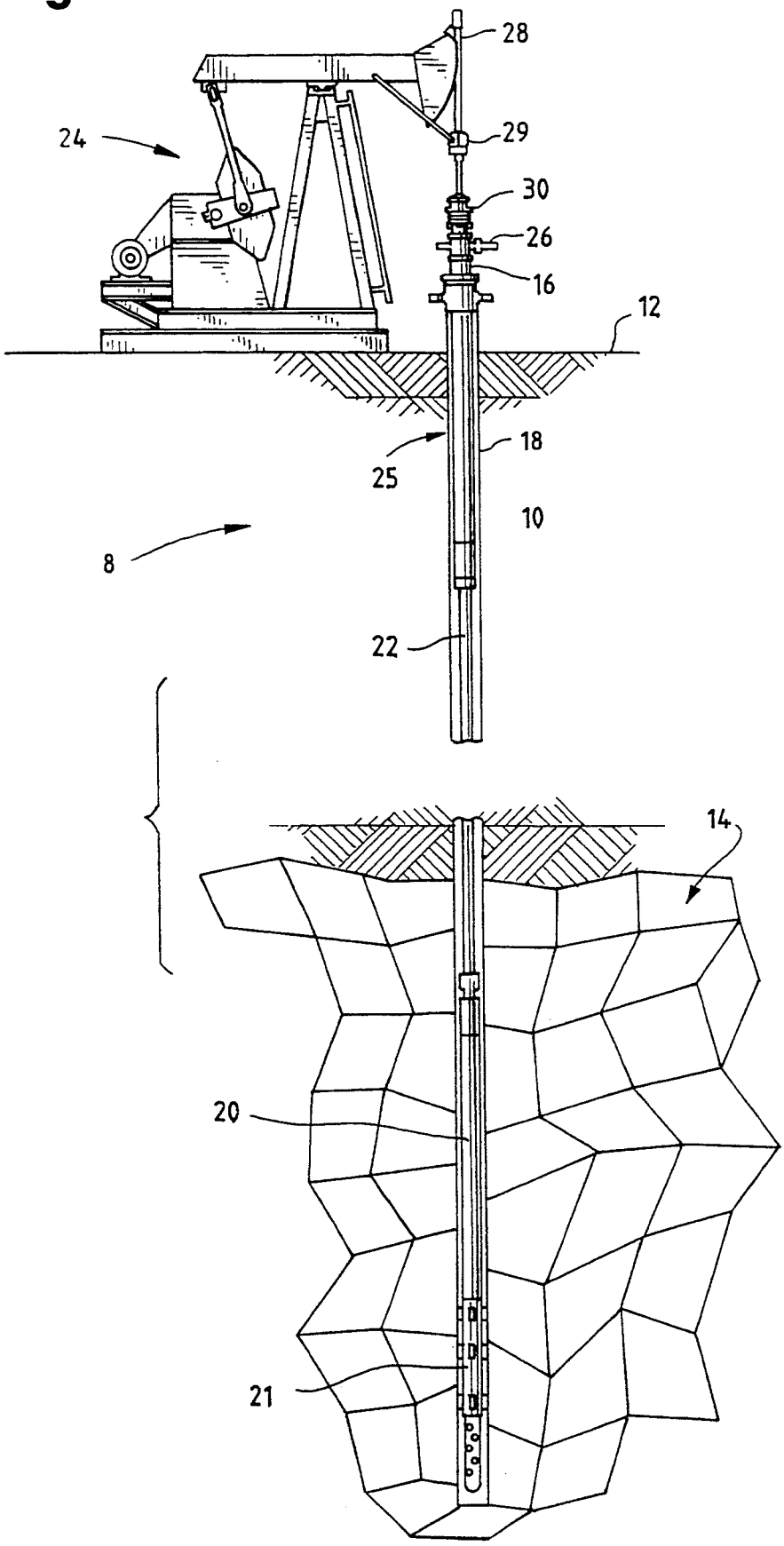
FIG. 1 is a schematic illustration of an artificial lifting system in which the present invention is employed.

The artificial lifting system of the present invention is illustrated schematically in FIG. 1 and is generally designated 8. The artificial lifting system is shown in a hydrocarbon producing application wherein a well bore 10 extends from the surface of the earth 12 down to an oil bearing formation 14. A wellhead 16 is fixed to a well casing 18, and a reciprocating pump 20 is fixed within the lower end of well bore 10 by a locking device 21 and is connected to the wellhead by a hollow string assembly, generally designated 22. Pump drive means in the form of a generally known jack unit 24 is mounted at the surface and, as will be discussed below, is operable to reciprocate string assembly 22. Reciprocation of the string assembly is effective to perform the dual functions of activating pump 20 and transporting oil from formation 14 upwardly through the well to fluid collection means, generally designated 25. Fluid is accumulated by collection means 25 and is discharged through a fluid outlet 26.

FIGS. 2–10 illustrate in a downwardly sequential fashion the components which comprise artificial lifting system 8. In order to facilitate an understanding of the lifting system, the top and bottom portions of FIGS. 2–10 include what is believed an appropriate degree of overlap with respect to the preceding and subsequent illustrations. Details of the specific components are recited following the sequential description provided hereinbelow.

Figure 2:
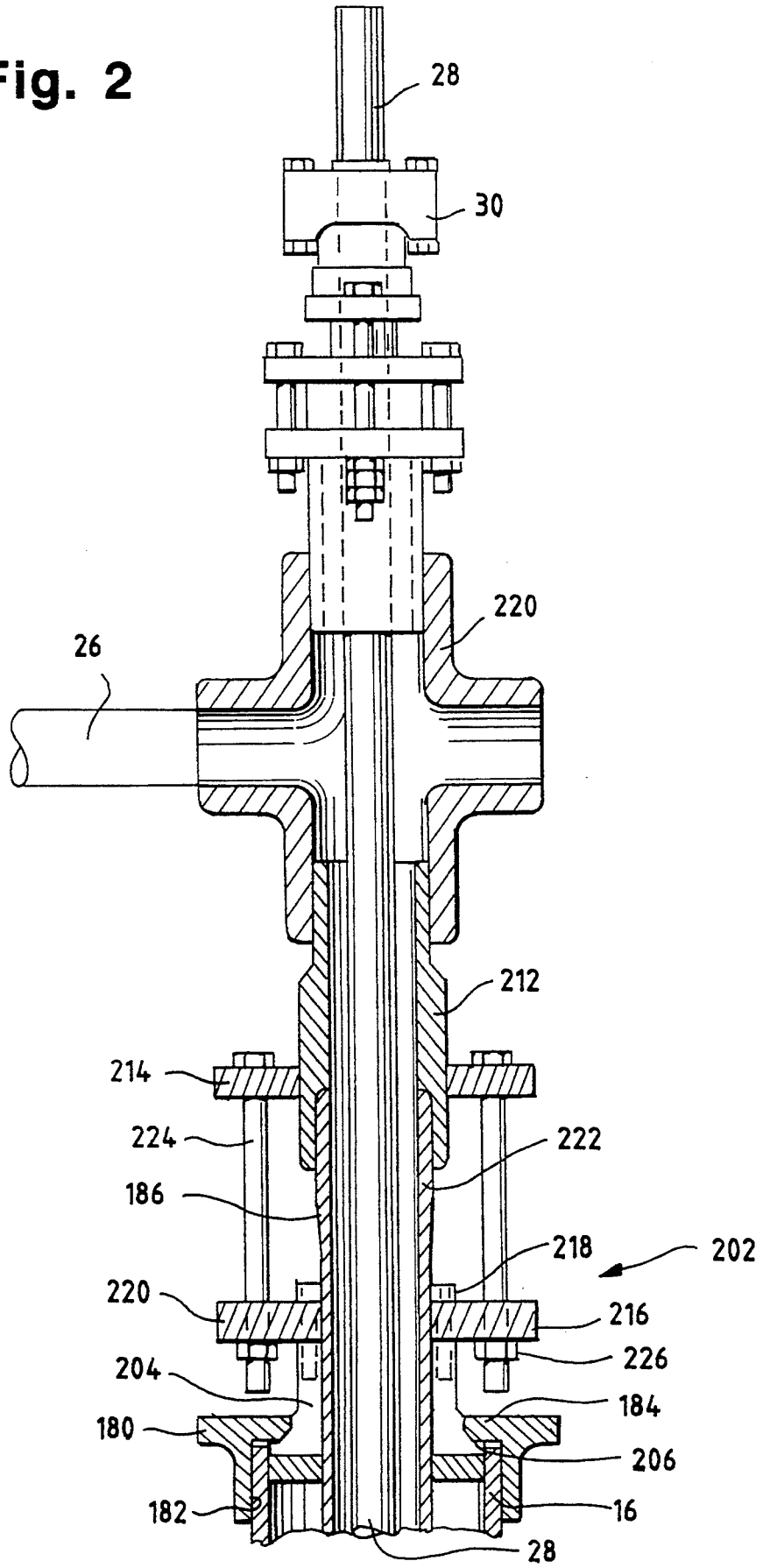
Figure 3:
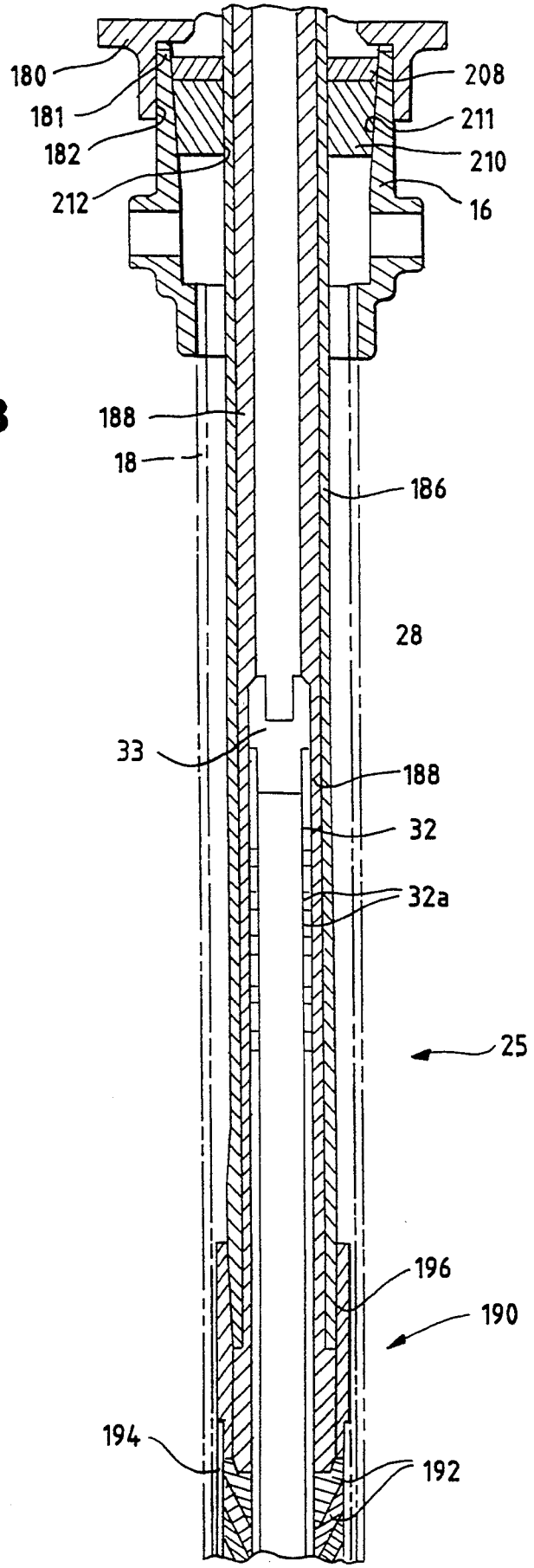

Beginning with FIGS. 2 and 3, a solid polished rod 28 is reciprocally driven by jack unit 24 through a stuffing box 30 on wellhead 16. A rod rotator 29 movably receives polished rod 28 and is operatively engaged with jack unit 24 for incrementally rotating polished rod 28 a predetermined number of degrees during each stroke of the jack unit. The polished rod is connected in series to a polished hollow tube 32 by means of a threaded coupling 33 which is received in the upper end of well casing 18. The polished hollow tube has a number of perforations 32*a* which communicate with the interior of hollow tube 32.

Figure 6:
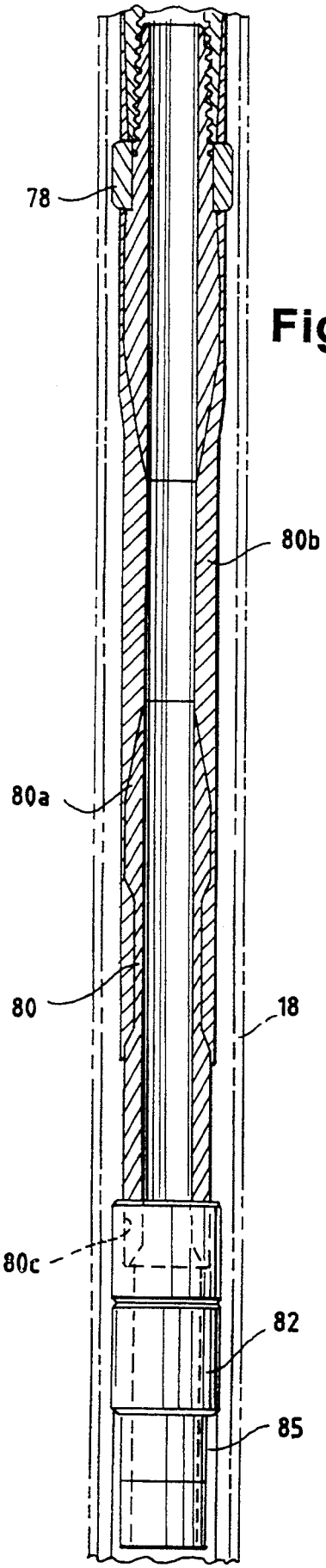

Referring next to FIGS. 4–6, hollow string assembly 22 includes composite tube means 34 coupled for vertical reciprocation with perforated tube 32. The composite tube means extends downwardly through the well bore to engage reciprocating pump 20 and is connected to the perforated tube 32 by a threaded polished tube adaptor 35 and an elongated metal/composite adaptor 37. Adaptor 37 advantageously is constructed of corrosion resistant metal and has a threaded upper end 37*a* engaged with polished tube adaptor 35 and a tapered lower end 37*b* bonded and entrapped within a composite tube connector 37*c*.

Composite tube means 34 is made up of a plurality of serially connected tubing segments, with each tubing segment having a length of approximately 40 feet. The construction of the individual tubing segments, as well as the manner in which the segments are connected, provide the strength of prior art lifting systems while greatly reducing corrosion and other degradation arising from hazards normally associated with doom-hole hydrocarbon-producing environments.

More specifically, and as described in greater detail below, composite tube means 34 is formed from a carbon and glass fiber-reinforced thermosetting epoxy resin in which the fibrous reinforcements make up approximately 60% of the composite material by volume. The composite material preferably has a density less than 0.1 pounds per cubic inch and provides an axial modulus of elasticity in excess of 700,000 psi. As a result of the strong, relatively lightweight construction of the individual tubing segments, the artificial lifting system is capable of reciprocating a composite tube which has a length sufficient to extract oil from well formations at depths ranging from approximately 2,000 feet to 12,000 feet below the surface of the earth.

Connector means, designated generally 50 in FIG. 5, are provided for joining the ends of a pair of adjacent composite tube segments 52 and 54. Of course, as noted above, the present invention envisions a tubing string 22 having a sufficient number of tube segments to collectively form a tube having a length sufficient to extract oil from a desired depth. Connector means 50 include tubular fittings 56 and 58 which cooperate to securely mate the adjacent tube segments and provide an impermeable seam for preventing the leakage of fluid which is transported by composite tube means 34. An anti-abrasion element 78 is mounted exteriorly of the seam between the ends of tube segments 52 and 54, respectively. Anti-abrasion element 78 prevents composite tube means 34 from striking well casing 18 during pumping operations. Rotation of polished rod 28 and string assembly 22 by rod rotator 29 assures uniform wear around the periphery of anti-abrasion elements 78.

An elongated metal/composite adaptor 80 is connected at the bottom of composite tube means 34. Metal/composite adaptor 80 is similar to adaptor 37 and is constructed of corrosion resistant metal. Adaptor 80 has a tapered upper end 80*a* bonded to a composite tube connector 80*b* and a threaded lower end 80*c* threadedly engaged with a cylindrical tubing drain 82.

Figure 7:
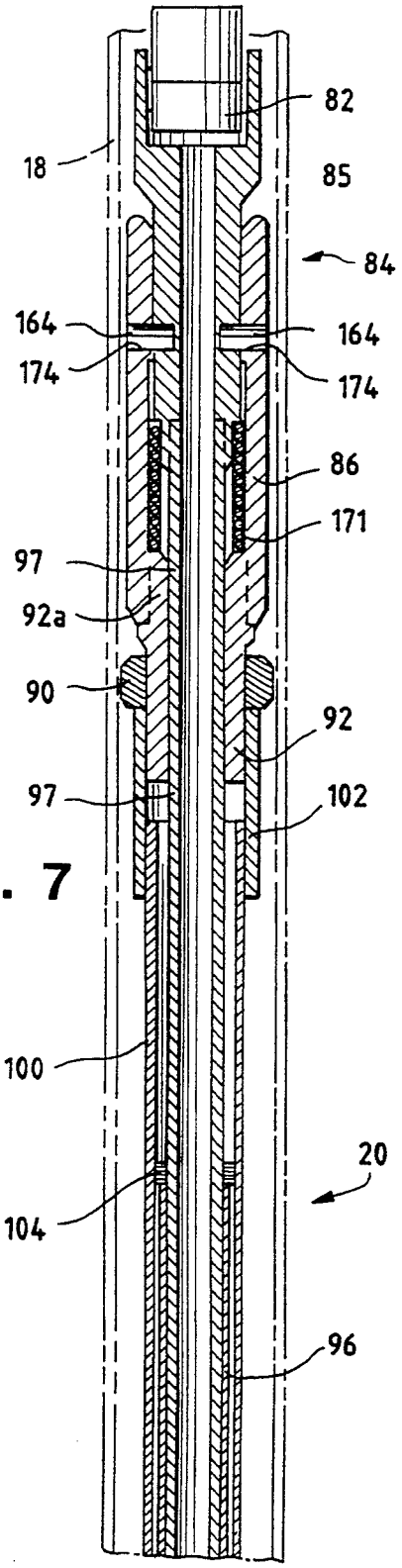
Figure 8:
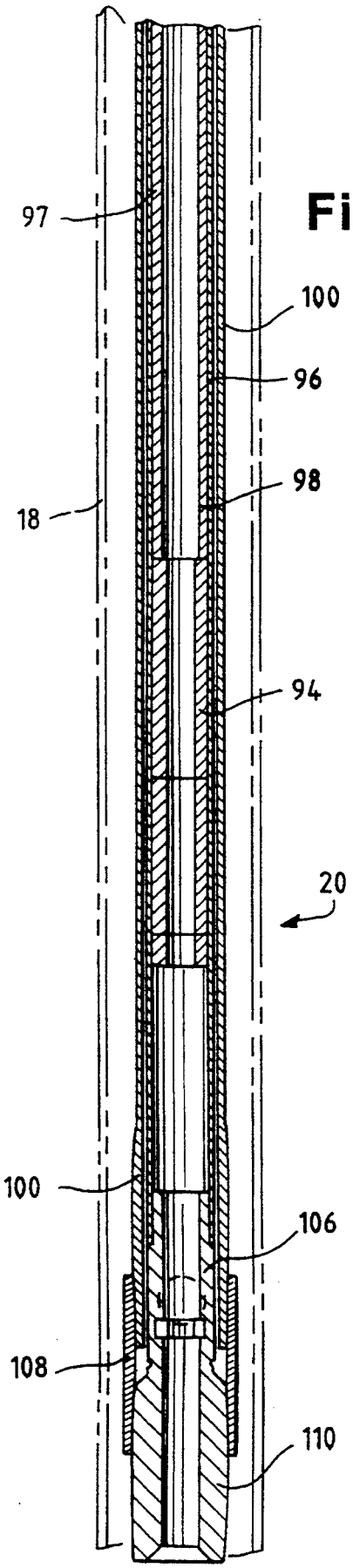

As shown also in FIG. 7, a two-piece J-lock mechanism 84 is connected below tubing drain 82 and permits the upper end of string assembly 22 to be selectively disengaged from pump 20 and locking device 21. To this end, J-lock mechanism 84 has a reciprocable body 85 releasably engaged with an elongated sleeve 86. A centralizing member 90 positions J-lock sleeve 86 within casing 18. For reasons which wall become apparent from the description below, the J-lock mechanism permits the transmission of torque to the lower portion of the tubing string by rotating the upper end of the string assembly, and, in addition, permits the upper end of the string assembly to be reciprocated independently of the lower portion of lifting system 8.

Pump 20 has a reciprocable plunger 94 (FIG. 8) and a cylindrical pump barrel 96. Plunger 94 is connected to J-lock body 85 with a rigid plunger tube 97 and a plunger tube adapter 98. The plunger tube adapter is cylindrical metal coupling having internally threaded opposite ends for interconnecting plunger tube 97 and reciprocable plunger 94. Pump barrel 96 is housed within a tubing segment 100 which, in turn, extends from a tubular adaptor 102 connected to J-lock centralizer 92. The pump barrel is positioned within tubing segment 100 by a pump barrel centralizer 104 and extends downwardly through casing 18 to a plunger cage and valve assembly 106. The cage and valve assembly is internally attached to the bottom of tubing segment 100 and supports pump barrel 96 within the tubing segment. Bottom locking device 21 is connected to the bottom of tubing segment 100 by means of a cylindrical tubing coupling 108 and a bottom lock adaptor 110.

Figure 9:
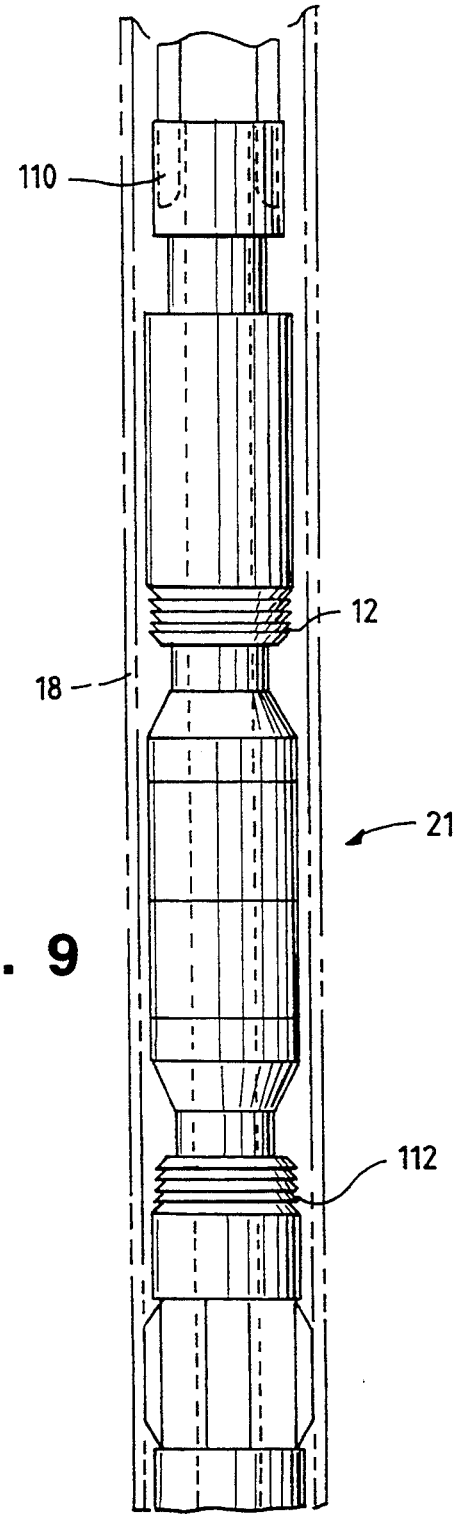
Figure 10:
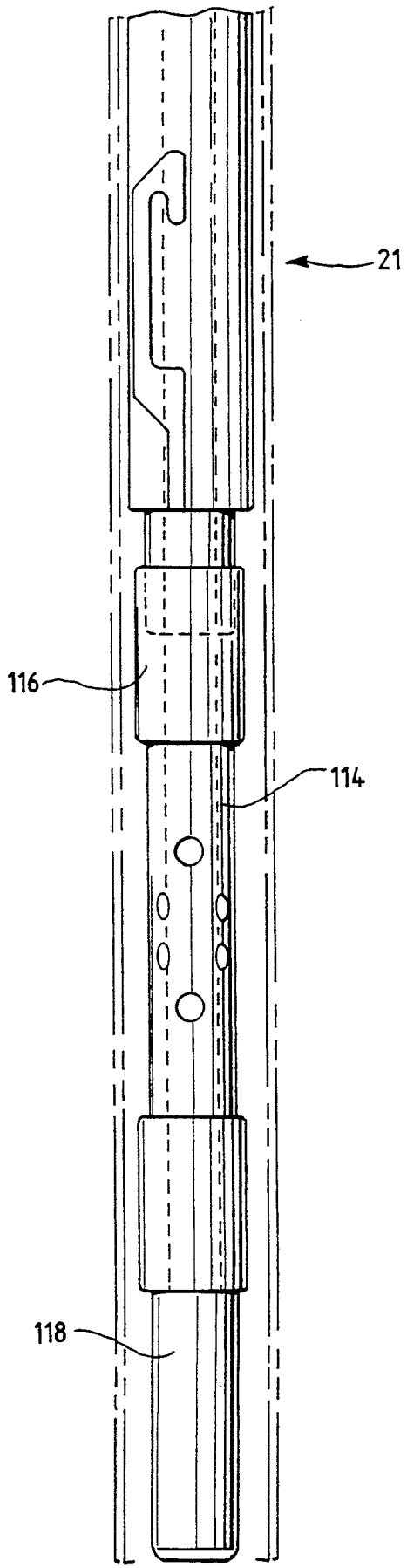

Referring lastly to FIGS. 9 and 10, bottom locking device 21 is a hollow elongated mechanism having two axially spaced series of radially extendable toothed locking slips 112. More particularly, it is envisioned that locking device 21 is of a commercially available character wherein locking slips 112 are alternatively extended and retracted in response to the application of torque or axial force to the upper end of string assembly 22. The extended locking slips engage the interior sidewall of well casing 118 to anchor the bottom of lifting system 8 during pumping operations. A perforated nipple 114 extends downwardly from a coupling 116 on locking device 21 and terminates at a bull plug 118.

Operation of lifting system 8 is summarized briefly as follows. Once an appropriate vertical well bore is drilled through the earth, well casing 18 is lowered into the well and wellhead 16 is secured to the upper end of the casing. The aforesaid components then are sequentially assembled and lowered through the well casing, beginning with bull plug 118 and perforated nipple 114. Bottom locking device 21 and pump 20 are then attached and lowered through the casing, followed by the described components of string assembly 22.

Following the installation of all of the aforesaid components, a torque is applied to the top of tubing string 22 to actuate locking slips 112 and anchor the bottom of lifting system 8 within the well. Application of torque disengages J-lock body 85 from J-lock sleeve 86 to permit vertical reciprocation of composite tube means 34, plunger tube 97, and plunger 94 independently of pump barrel 96. Relative axial movement between the pump plunger and pump barrel 96 draws oil from formation 14 through perforated nipple 114 and upwardly through composite tube means 34 and into collection means 25.

Figure 11:
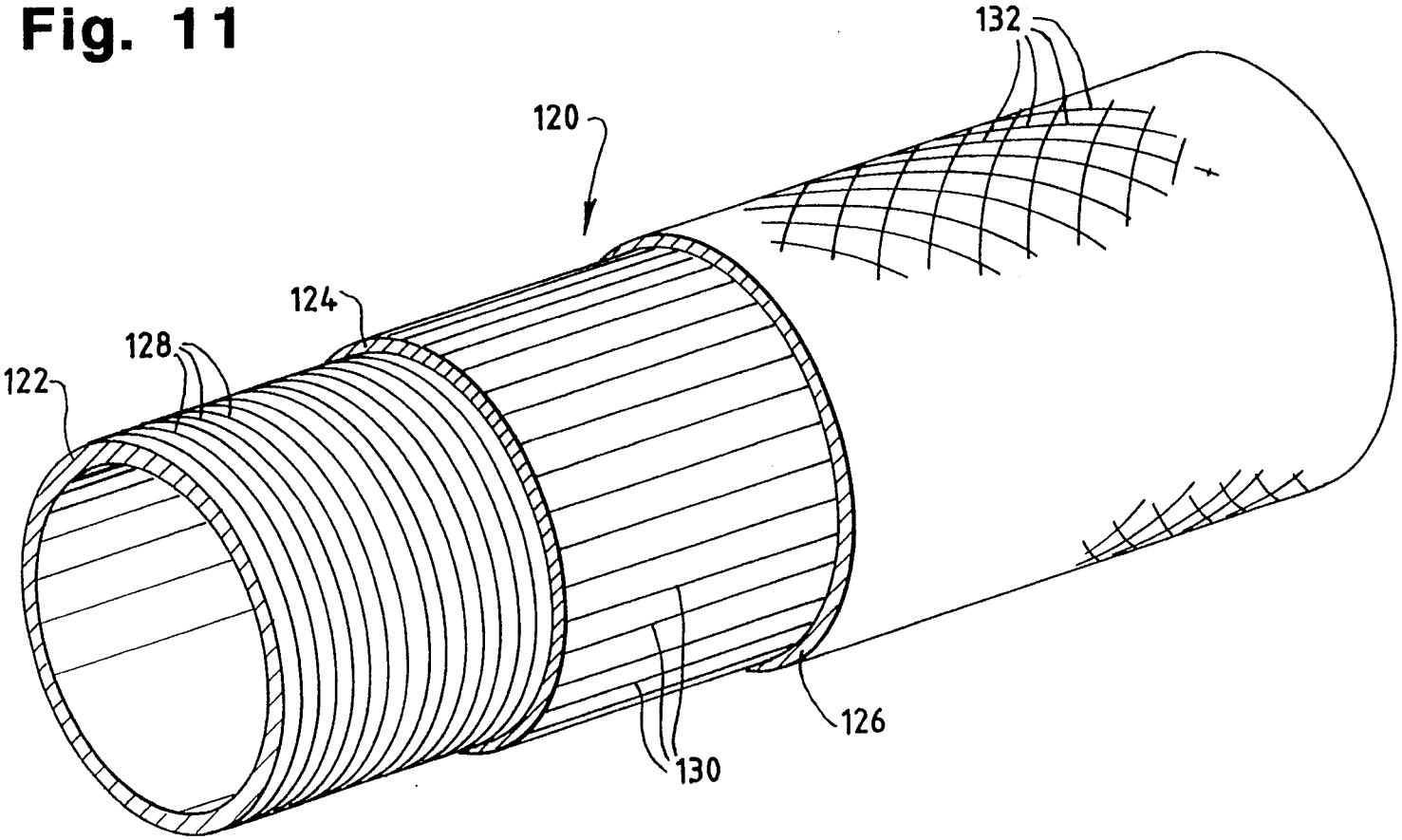
FIG. 11 illustrates the construction of a composite tubing segment.

As discussed above with respect to composite tube means 34, the tubing string is made up of a plurality of serially connected fiber-reinforced tube segments, with a representative tube segment designated generally 120 in FIG. 11. As previously discussed, the composite fiber and resin construction of the tube segments results in tube segments which have a density less than 0.1 pounds per cubic inch, and provide an axial modulus of elasticity in excess of 700,000 psi.

A preferred arrangement of reinforcing fibers which provides an axial modulus of elasticity in excess of 5,000,000 psi is illustrated in FIG. 11 with respect to tube segment 120, wherein it can be seen that the tube segment has a plurality of coaxial cylindrical layers or plies 122, 124, and 126. Each of the coaxial plies contains a thickness of wound fibers which are oriented with respect to the longitudinal axis of tube segment 120 so as provide the aforesaid material stiffness in segment 120.

In one construction, ply 122 has "hoop" fibers 128 which are wound about tube segment 20 at an angle of substantially ninety degrees with respect to the longitudinal axis of the tube segment and carry hoop or pressure loads. Accordingly, fibers 128 in ply 122 must be of a type possessing sufficient integrity to withstand internal pressurization of tube segment 120. Glass fibers which are wound to a thickness of approximately 0.120 inches have been found to provide acceptable levels of performance in ply 122 in wells having a depth of approximately 5,000 feet.

Ply 124 has "longitudinal" fibers 130 which are wound in alternating directions and at small angles with respect to the longitudinal axis of tube segment 120, such as plus and minus ten degrees. Due to the orientation of fibers 130, the fibers are adapted to carry axial loads and must be of a type possessing sufficient cyclic fatigue resistance to support the weight of lifting system 8. Carbon fibers which are wound to a thickness of approximately 0.050 inches have been found to provide acceptable levels of performance in ply 124 in wells having a depth of approximately 5,000 feet.

More particularly, carbon fibers characteristically provide relatively high resistance to static and dynamic fatigue failure. In terms of percent ultimate stress, the capability of carbon/epoxy composite materials to sustain static loads decreases over time at a more gradual rate than the decrease in static strength of other filament wound materials, such as fiberglass. Carbon/epoxy composite material also provides a substantially more constant relationship between the percentage of static strength which can be dynamically withstood as a function of fatigue cycles. Consequently, cyclic loading does not have as great an effect on the strength of the lifting system as in systems employing other filament wound materials, such as fiberglass.

Ply 126 has "helical" fibers 132 which are wound about tube segment 120 at alternating directions with respect to the longitudinal axis of the tube segment, such as plus and minus forty-five degrees. Due to the orientation of fibers 132, the fibers are adapted to carry torsional loads and must be of a type possessing sufficient integrity to transmit torque between the upper end and the lower end of tubing string 22. Glass fibers which are wound to a thickness of approximately 0.060 inches have been found to provide acceptable levels of performance in ply 126 in wells having a depth of approximately 5,000 feet.

Figure 12:
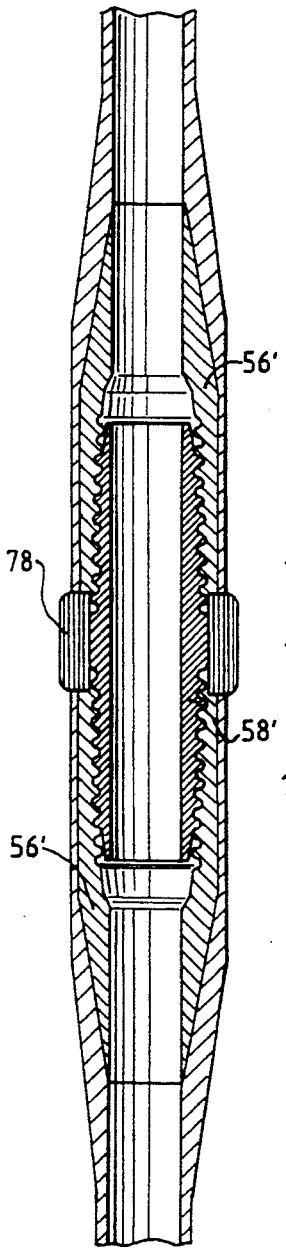
FIG. 12 illustrates an alternative embodiment of a composite connectors for joining a pair of adjacent composite tubing segments.
Figure 13:
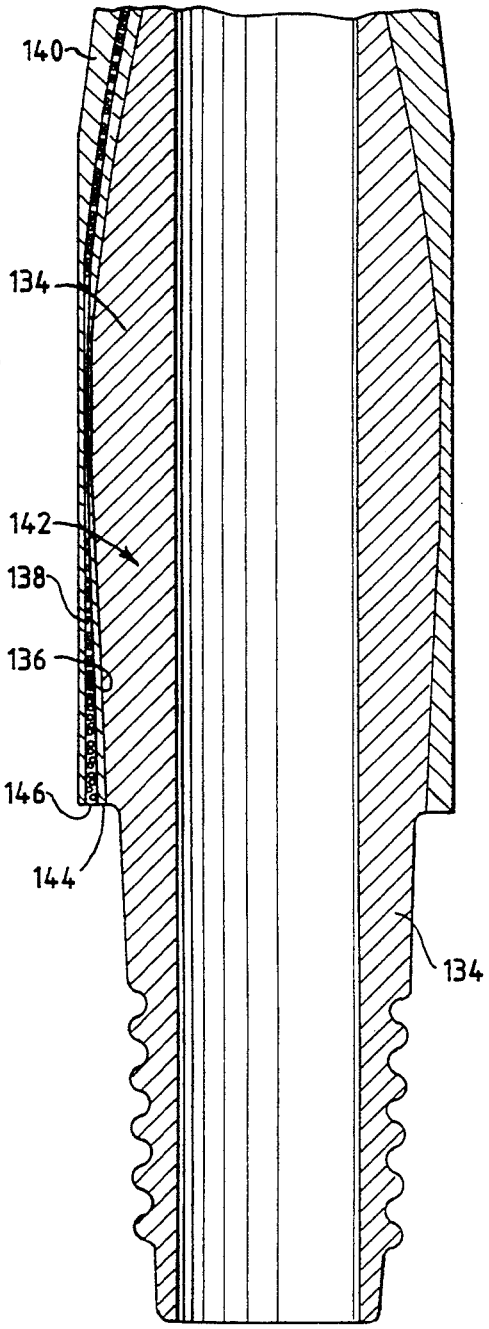
FIG. 13 illustrates the trap lock feature of the composite connectors.

The following discussion relates to the construction of connector means 50, as shown in FIGS. 5, 12 and 13. First referring to FIG. 5, tube segment 52 has a flared end 62 with a tapered inner sidewall 64. Tube segment 54 has a flared end 66 with a tapered inner sidewall 68. Fittings 56 and 58 are generally molded cylindrical tubes which are bonded to the respective composite tube segments by an adhesive film layer applied at the interface between the components. Fitting 56 has an internally threaded opening **56*a* for receiving an externally threaded end 58*a* of fitting 58. In an alternative connector illustrated in FIG. 12, an internally threaded molded fitting 56' is bonded to each opposite end of a pair of adjacent tube segments. A cylindrical fitting 58'** having axially spaced externally threaded ends is provided for joining the segments.

Tube segments 52 and 54 have a smooth inner sidewall 79 and 80, respectively, to facilitate the transportation of oil from reciprocating pump 20 to outlet 26. Each fitting 56 and 58 has a smooth inner sidewall portion **56*b* and 58*b*, respectively, which is aligned with the sidewalls 79 and 80 when the tube segments 52 and 54** are connected. The fittings are formed of fiber reinforced resin. Preferably the thread forms on the fittings are produced without cutting the fiber reinforcement and have a thread pitch less than six threads per inch.

FIG. 13 illustrates an exemplary construction of a film-adhesive bond for joining a threaded fitting with an associated composite tube segment. As shown in FIG. 13, a threaded fitting 134 has a tapered peripheral sidewall 136 which is bonded With a generally cylindrical sidewall 138 on a composite tube segment 140. An adhesive bond, generally designated 142, is established between tapered surface 136 and cylindrical surface 138 such that fitting 134 cannot be axially extracted from composite tube segment 140 without destroying the bond in a shear direction. More specifically, adhesive bond 142 is made up of adjacent layers of carbon' fiber 144 and surrounding carbon hoop plies 146. A thin layer of adhesive is applied between the adjacent layers 144 and 146 and sidewalls 136 and 138 to form a high strength trap for rigidly bonding the insert and the composite tube segment. In order for the fitting to move to the left, as shown in FIG. 13, the high strength carbon hoop ring 146 must separate or break before the fitting can be withdrawn.

Figure 14:
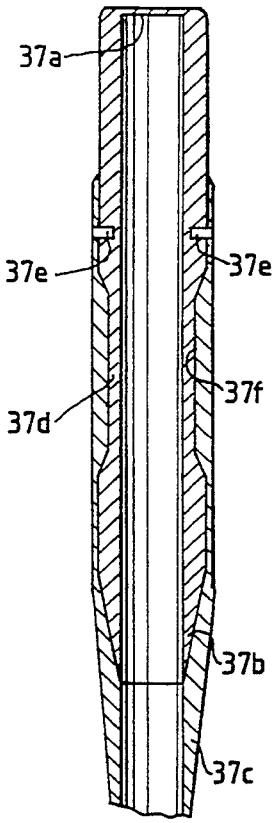
FIG. 14 illustrates a metal/composite transition member.

The described "traplock" also is provided on the metal/composite transition members 37 and 80. As shown with respect to transition member 37 in FIG. 14, each transition member includes a center section **37*d* necked to a smaller diameter intermediate a threaded opening at one end 37*a* and a gentle taper at an opposite end 37*b*. Composite material is wound over the taper of the transition member and is entrapped and bonded to the member in necked section 37*d*. Circumferential fibers hold the composite in the necked region and provide the noted traplock feature when cured. Pins 37*e* extend diametrically through the composite and the threaded end of member 37 to provide torsional resistance should the bond between the composite material and the member 37 fail. A rubber liner 37***f* is bonded between the member 37 and the composite material.

Figure 15:
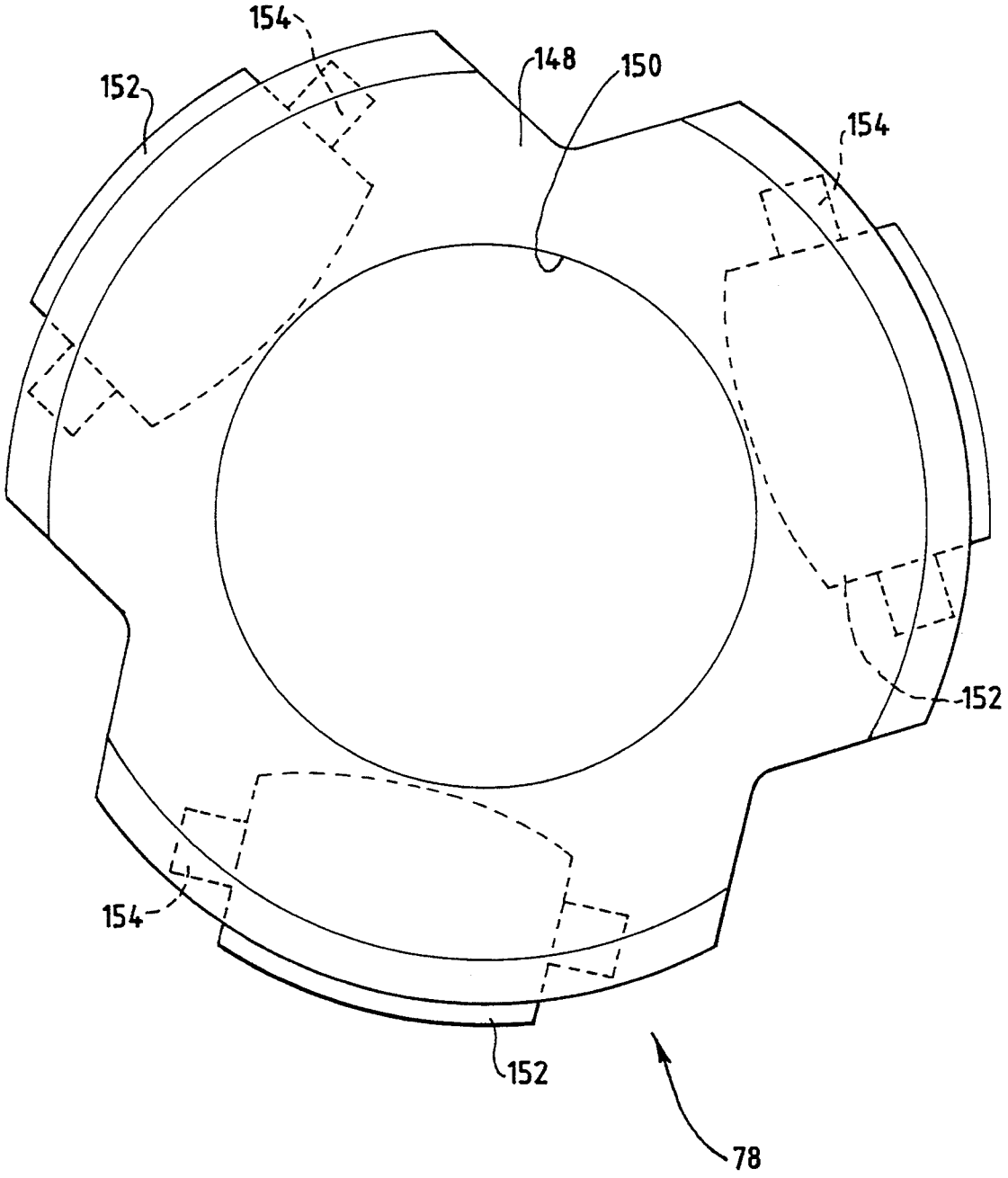

Anti-abrasion elements 78 are illustrated in FIGS. 15 and 16 and prevent composite tube means 34 from striking well casing 18 during pumping operations. In the preferred embodiment shown in FIG. 15, an anti-abrasion element 78 has a carrier 148 with a central opening 150 for receiving hollow string assembly 22. A plurality of rotatable elements 152 have associated axles 154 journaled on carrier 148. Rotatable elements 152 extend radially outward of the periphery of carrier 148 and engage the interior wall of well casing 18 to reduce frictional resistance between the well casing and an anti-abrasion element 78 when string assembly 22 is reciprocated in the well.

Alternatively, and as shown in FIG. 16, an anti-abrasion element 78' is an annular collar formed of nylon or ultrahigh molecular weight (UHMW) polyethylene. Anti-abrasion element 78' has axially spaced end openings 78*a'* and 78*b'* for receiving the ends of a pair of adjacent composite tubing segments.

J-lock body 85 and J-lock sleeve 86 are shown in greater detail in FIGS. 17 and 18, respectively. J-lock body 85 has a hub 156 with a reduced diameter shaft 158 extending therefrom. Hub 156 has a circular bore 160 for receiving fluid drain 82, and the shaft 158 has a longitudinal passage 162 in communication with bore 160. A pair of diametrically opposed pins 164 extend laterally from J-lock body 85. The lower end 166 of J-lock body 85 has an exterior annular groove 168 and an interior annular groove 170. Referring also back to FIG. 7, annular groove 168 seats a coil spring 171 which is interposed between the J-lock body and J-lock centralizer 92. Plunger tube 97 is threadedly engaged with interior annular groove 170.

J-lock sleeve 86 is a cylindrical member having an axial passage 172 for receiving shaft 158 on J-lock body 85. A pair of generally J-shaped slots 174 are formed in the sidewalls of J-lock sleeve 86 and are adapted to receive diametrically opposed pins 164 on the J-lock body. More particularly, each slot 174 has a crook portion 176 in which an associated one of pins 164 is disposed when lifting system 8 is lowered into a well. That is, the weight of locking device 21 and the biasing force generated by coil spring 171 maintain pins 164 in corresponding crook portions 176 and hold J-lock mechanism 84 in a locked position.

When a clockwise (as looking downward through passage 172) torque is applied to the top of string assembly 22 pins 164 engage the sidewall 176*a* of the crook portions 176 and J-lock sleeve 86 similarly is caused to rotate in a clockwise direction. Thus, the torque is transmitted to locking device 21, and the toothed locking slips 112 are extended into engagement with well casing 18. A counterclockwise torque then is applied to the top of string assembly 22 to rotate pins 164 out of engagement with sidewalls 176*a*. The J-lock body is rotated until pins 164 engage an axial slot portion 177 on each slot 174. String assembly 22 then is lifted to disengage J-lock body 85 from J-lock sleeve 86, whereby tubing string assembly 22 and plunger 94 can be reciprocated independently of pump barrel 96.

To remove the lifting system from a well, J-lock body 85 is lowered into engagement with J-lock sleeve 86 and pins 164 are guided downwardly through axial slot portions 177 of J-slots 174. When the J-lock body is fully lowered, string assembly 22 is rotated in a clockwise direction to move pins 164 into engagement with sidewalls 176*a* of crook portions 176. The torque is thereby transmitted to locking device 21, which, in turn, causes locking slips 112 to retract. The thusly unsupported weight of locking device 21 pulls J-lock sleeve 86 downward and forces pins 64 relatively upward into the crook portion 176 of each slot 174. String assembly 22 then can be extracted from the well bore.

Collection means 25 now will be discussed- As shown in FIG. 4, wellhead 16 is secured to the top of well casing 18 during installation of the well and is stationary with respect to ground. A wellhead cap 180 surrounds the upper end of wellhead 16 and is attached thereto along a threaded interface 182. Wellhead cap 180 has a radial flange 184 for purposes to be described.

An elongated metal tube 186 extends downwardly through wellhead cap 180 and surrounds perforated tube 32 to form an annular collection chamber 188 around the perforated tube and polished rod 28. Fluid which is drawn from formation 14 upwardly through hollow string assembly 22 is discharged through perforations 32*a* into collection chamber 188. Precision seal means, generally designated 190, slidably receive the bottom of perforated tube 32 and prevent fluid received in collection chamber 188 from leaking to the bottom of the well.

More particularly, and as shown in greater detail in FIG. 4, precision seal means 190 include a plurality of upward and outwardly flared cup seals 192 stacked within a cylindrical seal housing 194. The seal housing is connected to the bottom end of elongated tube 186 by an adaptor 196. A lower end 197 of seal housing 194 is engaged with a cylindrical seal retainer 198 and a coaxial seal compressor 199. A coil spring 200 is interposed between spring compressor 199 and the bottommost cup seal 192. Axially spaced spring centralizers 201*a* and 201*b* have an annular groove for seating opposite ends of spring 200. The coil spring continuously compresses cup seals 192 upward against adaptor 196. The cup-shaped construction of the seals causes an application of compressive axial force to continuously urge the seals into engagement with perforated tube 32 regardless of wear of cup seals 192.

Lockdown means, generally designated 202, are provided at the head of the well for supporting metal tube 186 at wellhead 16. As best illustrated in FIGS. 2 and 3, lockdown means 202 has a split lower lockdown member 204 with an annular flange 206 which is captured beneath flange 184 on wellhead cap 180. A rubber packing element 208 and tapered locking slips 210 are held against an upward and outwardly tapered wall 211 on wellhead 16. Locking slips 210 have a toothed wall 212 for engaging metal tube 186.

In order to provide a downward force on metal tube 186, lockdown means 202 has an upper lockdown member 212 with an integral collar 214 and a split plate 216 associated with lower lockdown member 204. Split plate 216 is attached to an unflanged upper end 218 of lower lockdown member 204 with a plurality of screws 220 after wellhead cap 180 is installed. Split locations in lower lockdown member 204 and split plate 216 are rotated to a position ninety degrees apart to provide a rigid unit when the two components are fastened together.

Upper lockdown member 212 is threadedly engaged at an upper end thereof with a standard T-fitting 220. The lower end of upper lockdown member 212 has an interior annular groove 222 for receiving the upper end of elongated metal tube 186. In order to apply and maintain a downward force on tube 186, a plurality of circumferentially spaced vertical rods 224 are secured between lockdown members 212 and 204 by means of internally threaded nuts 226. Appropriate rotation of nuts 226 draws lockdown members 212 and 204 toward each other and forces elongated tube 186 downward and into engagement with locking slips 210. The locking slip, in turn, are wedged into the annular space defined by upward and outwardly tapered wall 211 on wellhead 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An artificial lifting system for extracting oil and the like from an underground source, the lifting system being designed for use at a pumping installation having pump drive means at the head of a well and a pump with a reciprocable member secured in the lower end of the well, the improvement comprising hollow tubing string means extending axially between the head of the well and the pump for performing the dual functions of reciprocating the reciprocable member in response to activation of the pump drive means and for transporting oil from the underground source to the wellhead, the tubing string means including a plurality of tubing segments made of fiber-reinforced composite material and a fitting interconnected between adjacent ends of a pair of adjacent tubing segments for serially connecting said segments to define an elongated non-corrosive conduit, said fitting having a tapered sidewall received in the end of a tube segment and fibers wound about the fitting in an annular space between the tapered sidewall and the end of the tube segment to restrict withdrawal of the fitting from the tube segment end.

2. The lifting system of claim 1 in which the tube segments have a length in the range of about 20 feet to about 60 feet and said elongated conduit has a length in the range of about 2,000 to about 12,000 feet.

3. The lifting system of claim 1 in which a threaded fitting is located at each end of a tube segment.

4. The lifting system of claim 3 in which an externally threaded fitting is connected to one end of a tube segment and an internally threaded fitting is connected to an opposite end of the tube segment, the externally threaded fitting of one tube segment being rotatably received in the internally threaded fitting of an adjacent tube segment.

5. The lifting system of claim 3 in which an externally threaded fitting is connected to each end of a tube segment and a cylindrical barrel fitting has axially spaced internally threaded ends, the externally threaded fitting of a pair of adjacent tube segment being rotatably received in an associated one of the internally threaded barrel fitting ends.

6. The lifting system of claim 3 in which the threaded fittings are formed of fiber reinforced resin.

7. The lifting system of claim 3 in which the threaded fittings have a thread pitch of less than six threads per inch.

8. An artificial lifting system for extracting oil and the like from an underground source, the lifting system being designed for use at a pumping installation having pump drive means at the head of a well and a pump with a reciprocable member secured in the lower end of the well, the lifting system comprising:

a hollow tubing string extending axially between the head of the well and the pump for performing the dual functions of reciprocating the reciprocable member in response to activation of the pump drive means and for transporting oil from the underground source to the wellhead, the tubing string including a metal conduit, a conduit formed of fiber reinforced composite material, and an elongated metal transition member interposed between the metal conduit and the composite conduit, the transition member having a threaded composite fitting attached thereto for facilitating a connection with the composite conduit.

9. An artificial lifting system for extracting oil and the like from an underground source, the lifting system being designed for use at a pumping installation having pump drive means at the head of a well and a pump with a reciprocable member secured in the lower end of the well, the lifting system comprising:

a hollow tubing string extending axially between the head of the well and the pump for performing the dual functions of reciprocating the reciprocable member in response to activation of the pump drive means and for transporting oil from the underground source to the wellhead, the tubing string including a metal conduit, a conduit formed of fiber reinforced composite material, and an elongated metal transition member interposed between the metal conduit and the composite conduit, the transition member having a threaded composite fitting attached thereto for facilitating a connection with the composite conduit, wherein the transition member has a tapered end for engaging the composite fitting and a threaded end for engaging the metal conduit, the transition member having a necked portion intermediate the tapered end and the threaded end.

10. The lifting system of claim 9 wherein composite material is wrapped about the necked portion and the tapered end of the transition member to restrict axial withdrawal of the composite fitting from the transition member.

11. The lifting system of claim 9 wherein a pin extends through the composite material and the transition member.

12. An artificial lifting system for extracting oil and the like from an underground source the lifting system being designed for use at a pumping installation having pump drive means at the head of a well and a pump with a reciprocable plunger secured in the lower end of the well, the improvement comprising a tubing string connected between the pump drive means and the plunger and mounted for reciprocating movement through a wellhead assembly for performing the dual functions of reciprocating the plunger in response to activation of the pump drive means and for transporting oil from the underground to the wellhead;

a plurality of openings in an upper end of the tubing string for discharging oil which is transported thereby;

an elongated collection tube surrounding said tubing string openings;

anchor means for securing an upper end of the collection tube to the wellhead assembly; and seal means at a lower end of the collection tube for slidable sealing engagement with the tubing string, whereby the fixed collection tube defines an annular collection chamber around said tubing string openings and in communication with the wellhead assembly, said seal means comprising an upwardly opening cylindrical housing connected to a lower end of the collection tube and having an end wall and an opening adapted for slidable engagement with the tubing string, an annular cup seal having a downward and radially inwardly tapered sidewall in the housing, the cup seal having a central opening for slidably receiving the tubing string, a radial projection on the tubing string for limiting upward movement of the cup seal relative to the tubing string, and a spring between the bottom of the housing and the cup seal for biasing the seal into engagement with the radial projection to force the tapered sidewall into sealing engagement with the tubing string.

13. The lifting system of claim 12 in which the wellhead assembly includes grip means engageable with the collection tube for opposing downward movement of the collection tube, the anchor means comprising a lockdown means for opposing upward movement of the collection chamber and maintaining the collection tube in engagement with the grip means.

14. The lifting system of claim 13 including a first lockdown member fixed to the collection tube and a second lock down member fixed to the wellhead assembly, and means for drawing the first lockdown member and the second lockdown member toward each other.

15. The lifting system of claim 14 in which the means for drawing the lockdown members toward each other include a plurality of rods connected between the members and having threaded ends for adjustable engagement with complementary nuts.

16. The lifting system of claim 2 in which a series of annular cup seals are stacked between the spring and the radial projection.

* * * * *